US005174319A

United States Patent [19]

Chou et al.

[11] Patent Number: 5,174,319

[45] Date of Patent: Dec. 29, 1992

[54] LONGER EFFECTIVE AUTOMATIC UMBRELLA

[75] Inventors: Luc L. Chou; Jonathan C. Cheng, both of Taipei, Taiwan

[73] Assignee: DAT, Sheng-Tong, Taichung, Taiwan

[21] Appl. No.: 899,767

[22] Filed: Jun. 17, 1992

[51] Int. Cl.[5] ..... A45B 11/00

[52] U.S. Cl. ..... 135/20.3; 135/24; 135/25.4

[58] Field of Search ..... 135/20.3, 22-24, 135/15.1, 28, 25.4

[56] References Cited

U.S. PATENT DOCUMENTS

| | | | |
|---|---|---|---|
| 534,058 | 2/1895 | Ackermann et al. | 135/20.3 X |
| 680,661 | 8/1901 | Hunt | 135/24 |
| 3,129,715 | 4/1964 | Militano et al. | 135/20.3 |
| 3,175,568 | 3/1965 | Kafka | 135/20.3 |
| 3,801,809 | 4/1974 | Slade | 135/20.3 X |
| 4,928,718 | 5/1990 | Apple | 135/22 |
| 5,029,596 | 7/1991 | Tung | 135/20.3 |
| 5,078,165 | 1/1992 | Wu | 135/24 |
| 5,088,512 | 2/1992 | Chou et al. | 135/24 |

*Primary Examiner*—Richard E. Chilcot, Jr.
*Assistant Examiner*—Lan Mai
*Attorney, Agent, or Firm*—Pro-Techtor International

[57] ABSTRACT

A longer effective automatic umbrella comprising mainly a tubular shank provided with an upper pulley therein; a cylinder at top end of the shank for receiving an umbrella opening spring; a handle at lower end of the shank, having upper and lower clamps and a middle pulley; an actuating mechanism comprising a pair of springs co-extending through the lower and upper clamps and at most up to the upper pulley to accumulate the energy; and an actuator to actuate and release the upper and lower clamps, respectively, for controlling the operation of opening and closing the umbrella.

3 Claims, 5 Drawing Sheets

LONGER EFFECTIVE AUTOMATIC UMBRELLA

BACKGROUND OF THE INVENTION

This invention relates to an automatic umbrella, more particularly, to an umbrella which is longer effective for a number of operations once an active energy is accumulated.

The same assignee disclosed in U.S. Pat. No. 5,088,512, a lightly operable fully automatic umbrella which can be opened and closed automatically. Said umbrella is operated by a relatively small force applied onto an umbrella closing spring positioned at the intermediate of the shank. By the way, an umbrella opening spring disposed on the top end of said shank is maintained in a compressed, energy accumulated position when the umbrella is kept in the closing state before opening, whereas said umbrella closing spring is also maintained in a compressed, energy accumulated position when the umbrella is kept in the opening state before closing. As soon as an actuating member is operated to release respective lock means, the umbrella opening or closing spring will be responded immediately to proceed fast and positive operation.

But with this umbrella, when the energy is accumulated the umbrella can be opened and closed automatically once only. In other words, before the opening of the umbrella each time, said umbrella closing spring should be compressed to present the preparative state.

SUMMARY OF THE INVENTION

It is, therefore, an object of the present invention to provide an improvement over the mentioned prior patent application for capable of operating a number of actions in opening and closing the umbrella when an active energy is once accumulated.

In order to achieve this object, an actuating mechanism is contemplated instead of the umbrella closing spring in the mentioned prior patent application, which is incorporated herein for the reference.

The longer effective automatic umbrella according to the present invention comprises a tubular shank having upper and lower apertures, a longitudinal guide groove having a through hole communicating with the interior of said shank, a middle ring provided at the end that connected with an extension, and an upper pulley provided in said middle ring; a cylinder mounted around said extension for receiving an umbrella opening spring herein, and provided with an upper ring at outer lower end; a slidable lower ring mounted around said shank having a pawl, including an inner sleeve having a slot; a handle mounted at lower end of said shank, having upper and lower clamps, a wire and a middle pulley, the upper end of said wire extending out of said through hole in said guide groove of said shank and hooking onto said inner sleeve while the lower end of said wire being engaged with said lower clamp; an actuating mechanism comprising a compartment provided at utmost end of said handle, a pair of reels disposed within said compartment, a pair of spiral springs wound around respective reel and co-extending through said lower and upper clamps, a pull rope wound around a lower pulley and extending over said upper and middle pulleys and finally out of said shank, and a slide block engaged on said rope; and an actuator with a pair of presses to actuate or release said upper and lower clamps, respectively, for controlling the operation of opening and closing the umbrella.

With the longer effective automatic umbrella according to the present invention, once said rope is pulled to raise said spiral springs from said upper clamp up to said upper pulley an active energy is accumulated for automatic operation of the umbrella, in each operation of said umbrella said spiral springs are taken up by said reels in a length equal to the displacement of said lower clamp only. Since the distance from said upper clamp to said upper pulley, i.e. approximately the length of said shank, is greater than the displacement of said lower clamp, i.e. approximately the length of said handle, at least twice, say five times, so that the active energy that once accumulated can be used for automatic closing the umbrella five times.

BRIEF DESCRIPTION OF THE DRAWINGS

The foregoing and other objects, features and advantages of the invention will be apparent from the following particular description of preferred embodiment of the invention as illustrated in the accompanying drawings, in which.

DETAILED DESCRIPTION OF PREFERRED EMBODIMENT

Figure 1:
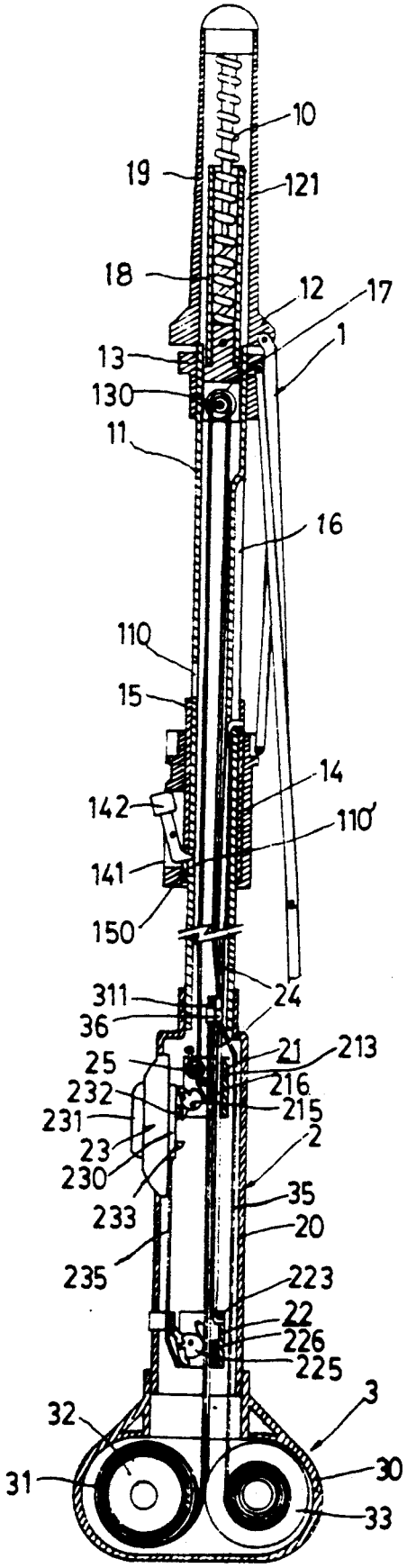
FIG. 1 is a partly sectional elevation illustrating the automatic umbrella of the invention in the closing state.

Now, reference is made to FIG. 1 which shows that the automatic umbrella according to the present invention mainly comprises a canopy struction 1, a handle 2 and a knob 3. In the following description, some parts having similar functions as corresponding components depicted in the aforementioned prior patent application incorporated herewith for reference may be neglected.

The canopy structure 1 comprises an elongated tubular shank 11 having an upper aperture 110 and a lower aperture 110', a longitudinal guide groove 16 having a through hole communicating with the interior of said shank 11, a middle ring 13 provided at the end that connected with an extension 18, and an upper pulley 130 provided in said middle ring 13. A cylinder 19 is mounted around and has a length greater than said extension 18. An umbrella opening spring 10 is disposed around a guide pin, as shown, within said cylinder 19 and extended into said extension 18. In response to the compression and expansion of said umbrella opening spring 10, said extension 18 is retractably movable in the space 121 within said cylinder 19. An upper ring 12 is provided at outer lower portion of said cylinder 19. A slidable lower ring 14 is mounted around and displaceable with respect to said shank 11. Said lower ring 14 has a recess 141 for receiving a pawl 142 biased inwardly and an inner sleeve 15 having a slot 150. In the illustrated closing state of the umbrella, said slot 150 is aligned with said lower aperture 110', so that said pawl 142 is engaged thereinto to make said slidable sleeve 15 secured in said closing state.

The handle 2 is mounted at lower end of said shank 11. The handle 2 comprises a casing 20, a fixed upper clamp 21, a movable lower clamp 22, an actuator 23, a wire 24 and a middle pulley 25.

Figure 2:
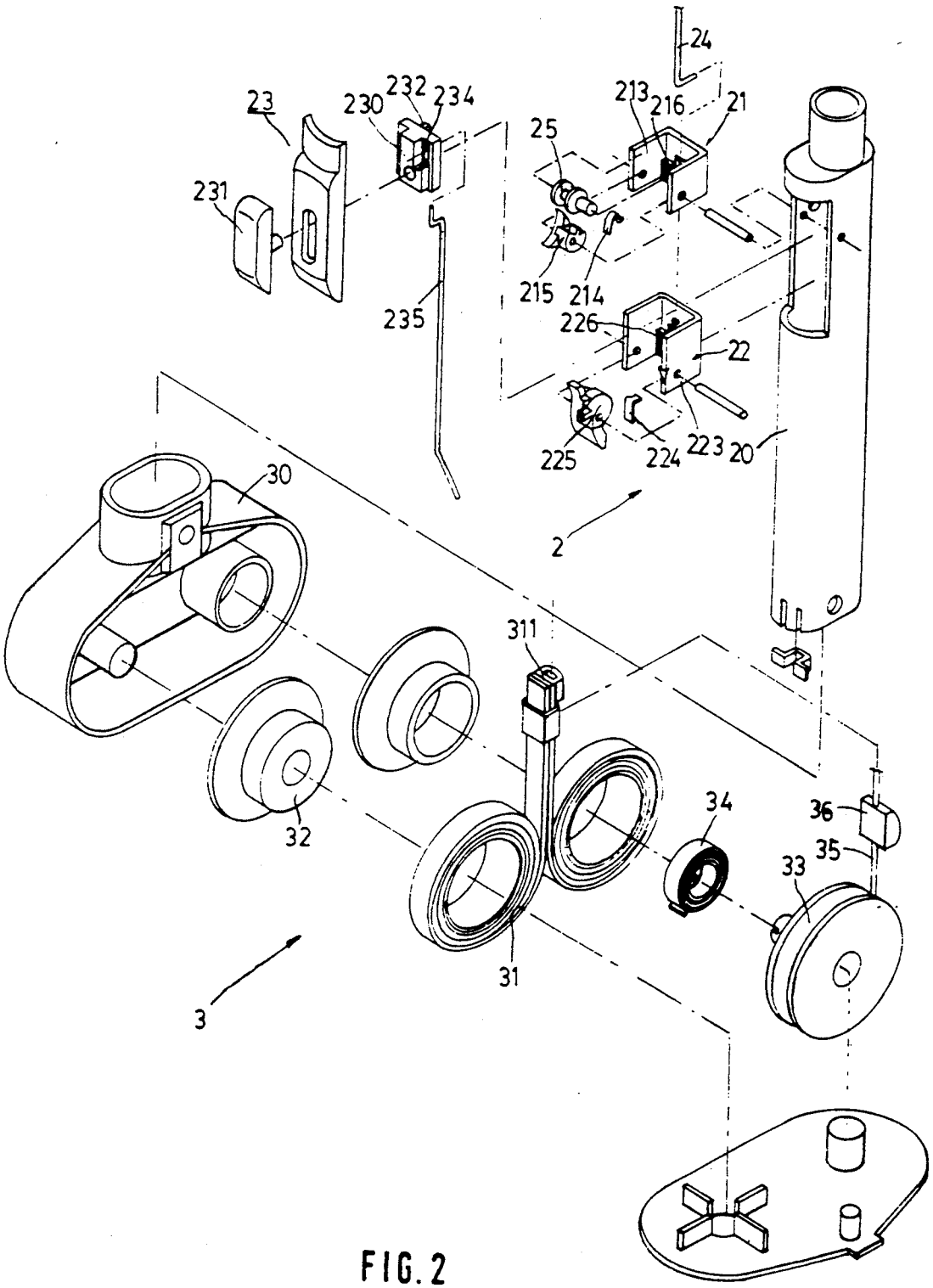
FIG. 2 is an exploded perspective view illustrating the handle and the actuating mechanism.

Also referred to FIG. 2, the clamps 21 and 22 are identical to each other and comprise bases 213, 223, leaf springs 214, 224, wing type cams 215, 225 and brakes 216, 226, respectively. Said wire 24 is at upper end extended out of said through hole (not indicated by reference symbol) in said guide groove 16 of said shank 11 and hooked into said inner sleeve 15, while at lower end engaged with said lower clamp 22.

The actuator 23 disposed at one side of said casing 20 comprises a controller 230 at underside, a push button 231 at upper side to engage with said controller 230 through said actuator 23, an upper press 232 and a lower press 233, both integrally formed at the bottom of said controller 230, a slot 234 and an extension wire 235 passing through said slot 234.

Figure 3:
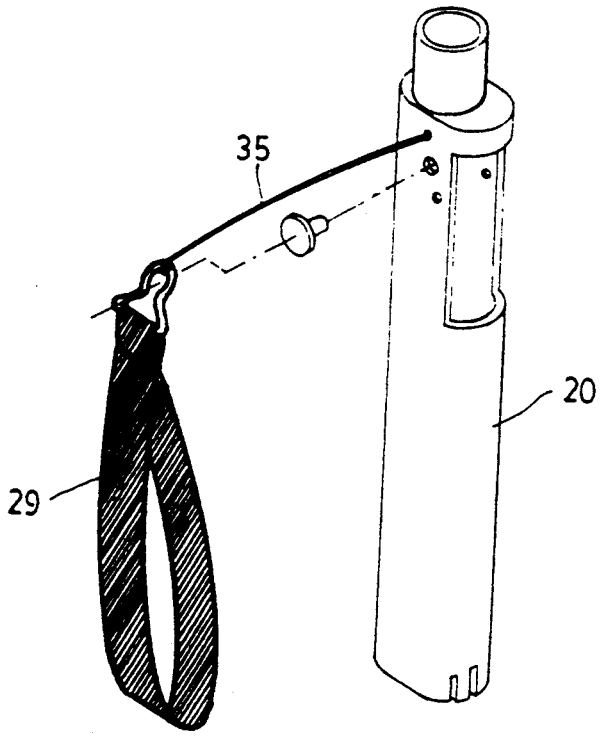
FIG. 3 is a perspective view illustrating the handle and the rope with a loop.

An actuating mechanism housed within the knob 3 comprises a compartment 30, a pair of spiral springs 31 synchronously movable face-to-face to each other and wound around respective reel 32, a lower pulley 33 coupled with one of said reel 32, and a return spiral spring 34 received within said reel and around a spindle of said pulley 33. The spiral springs 31 have an end protrusion 311 and co-extended through the passages between the cams 225, 215 and the brakes 226, 216, respectively, of said lower and upper clamps 22 and 21. A pull rope 35 wound around said lower pulley 33 is extended over said upper pulley 130 and middle pulley 25 and finally out of said shank 11. A loop 29 is connected at outer end of said rope 35 for readily pulling it as shown in FIG. 3. A slide block 36 is engaged on said rope 35 and abutted beneath the end protrusion 311 of said spiral springs 31.

In operation, when the automatic umbrella of the invention is in the closing state as shown in FIG. 1, the umbrella opening spring 10 is in compressed position. In preparation to open the umbrella, the user at first pulls the rope 35 over the upper and middle pulleys 130 and 25 out of the lower pulley 33 by means of the loop 29. The block 36 on said rope 35 will push the end protrusion 311 and thus the spiral springs 31 extensibly up to the upper position in said shank 11, until at most close to said upper pulley 130. As soon as the pulling force is released the rope 35 will be taken up again by said lower pulley 33 under the action of the return spring 34. And the spiral springs 31 are retained in the energy accumulated extended position by means of the clamps 21 and 22.

Figure 4:
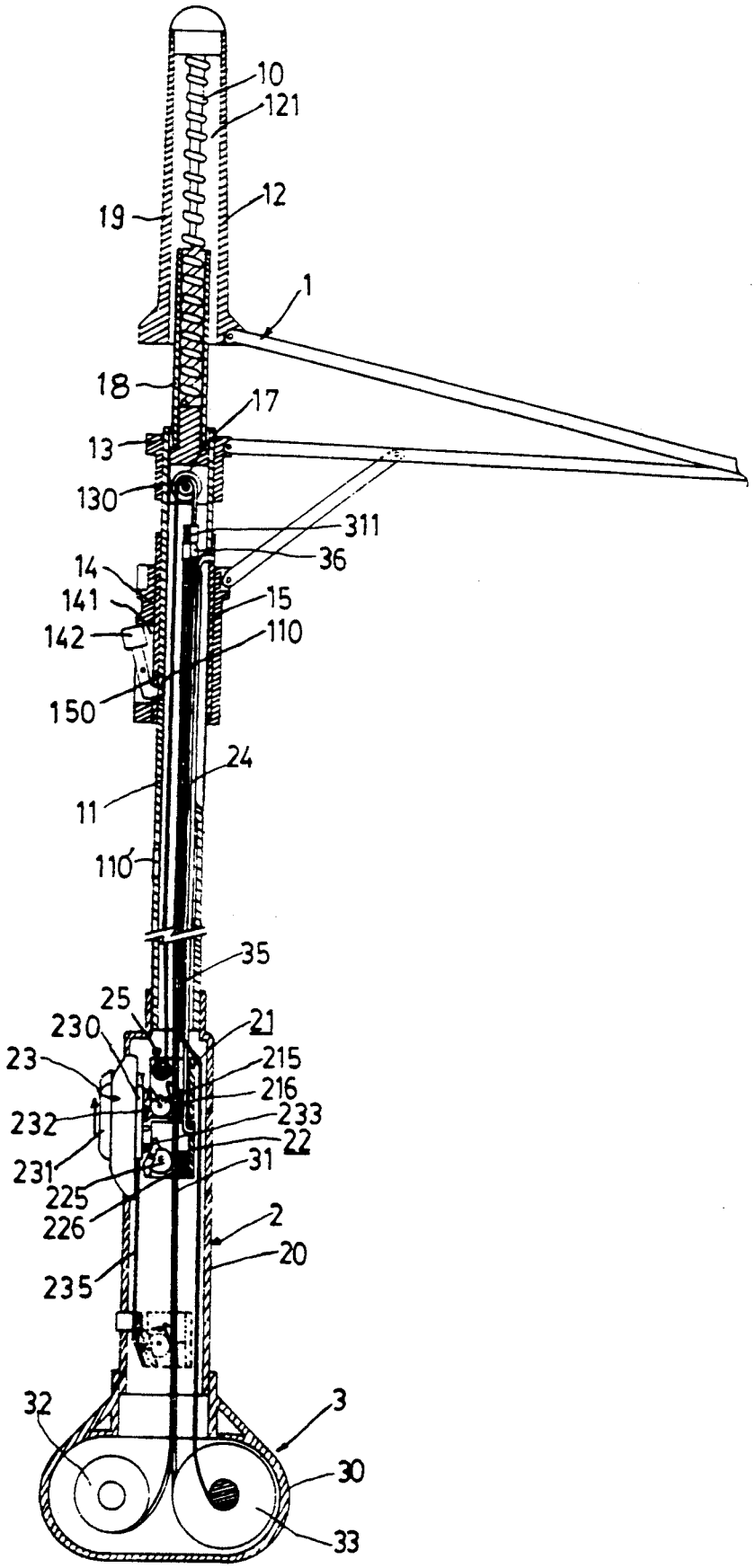
FIG. 4 is a partly sectional elevation illustrating the umbrella in the opening state.
Figure 5:
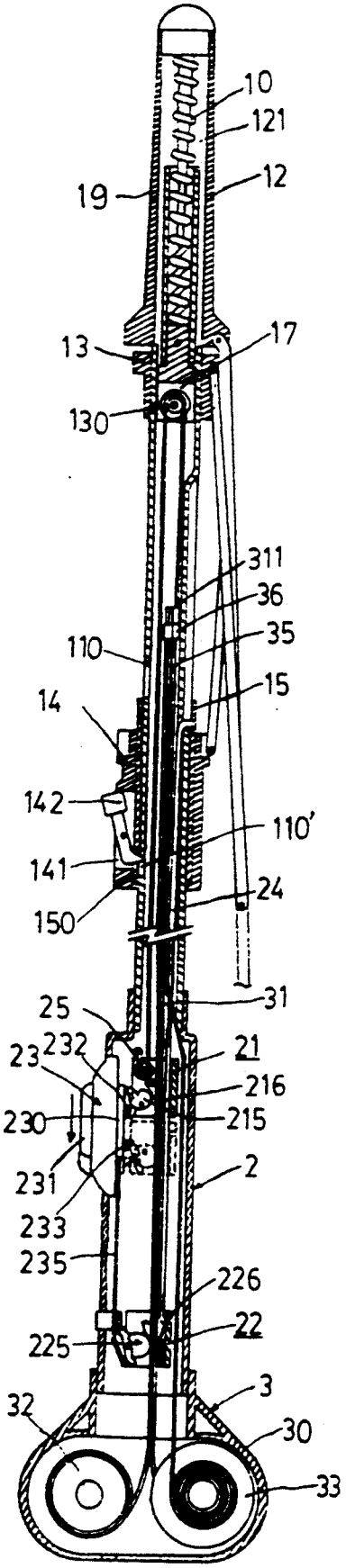
FIG. 5 is a partly sectional elevation illustrating the umbrella in the first closing state.

When the umbrella is going to be opened, the push button 231 is driven upwards, the upper press 232 will push the cam 215 of the upper clamp 21 in upward direction to keep a pressure over said springs 31 against the brake 216 presenting a clamping position, then the deflected end of the extension wire 235 during the upward movement will push the cam 225 of the lower clamp 22 to a release position. Under this circumstance, the umbrella opening spring 10 is spontaneously expanded from the compressed state. Thereby, the middle ring 13 is moved downwards while the lower ring 14 upwards in relation to said shank 11, and the pawl 142 is released from the aperture 110'. At the sametime, the lower clamp 22 is displaced upwards to abut the upper clamp 21 by means of the wire 24. And the canopy structure 1 is now automatically opened, as shown in FIG. 4. In this state the slot 150 of the sleeve 15 is aligned with the upper aperture 110 of the shank 11, so that the pawl 142 is engaged into said aperture 110 to become fixed state in the opening of the umbrella.

When the opened umbrella is going to be closed, the push button 231 is driven downwards, the lower press 233 will push the cam 225 of the lower clamp 22 in downward direction to keep a pressure over the spiral springs 31 against the brake 226 presenting a clamping position, then the press 232 will simultaneously push the cam 215 of the upper clamp 21 in downward direction to a release position. As soon as the clamping action of the upper clamp 21 is released, the springs 31 will be taken up by the reels 32 due to own accumulated energy under extension until the lower clamp 22 is displaced downwardly and stopped by the deflected end of the extension wire 235. In this course, the lower ring 14 is pulled downwards by the wire 24 and the middle ring 13 is relatively moved upwardly to make the spring 10 in compressed state. The pawl 142 is released from the upper aperture 110 and engaged into the lower aperture 110' again. Now, the umbrella is automatically closed.

During the process of closing the umbrella, the springs 31 are taken up by the reels 32 for a length equal to the displacement of said lower clamp 22 which is much less than the length of the shank 11, namely, the distance that said spring 31 are fully extended by pulling the rope 35 to accumulate the energy to be used for the operation in opening and closing the umbrella. In other words, once the springs 31 are extended to accumulate the energy, the umbrella can be operated automatically for at least twice, say about five times.

Although the invention has been described in detail with reference to its presently preferred embodiment, it will be understood by the persons skilled in the art that various modification, changes and variations can be made without departing from the spirit and scope of the invention.

What we claim is:

1. A longer effective automatic umbrella comprising, in combination:

a tubular shank having a length, upper and lower apertures, upper and lower ends, a longitudinal guide groove having a through hole communicating with the interior of said shank, a middle ring provided at said upper end that connected with an extension and an upper pulley provided in said middle ring;

a cylinder having an outer lower end mounted around said extension for receiving an umbrella opening spring herein, and provided with an upper ring at said outer lower end;

a slidable lower ring mounted around said shank having a pawl, including an inner sleeve having a slot;

a handle mounted at lower end of said shank, having an utmost end, a length upper and lower clamps, a wire includes upper and lower ends, and a middle pulley, the upper end of said wire extending out of said through hole in said guide of said shank and hooking onto said inner sleeve while the lower end of said wire being engaged with said lower clamp;

an actuating mechanism comprising a compartment provided at utmost end of said handle, a pair of reels disposed within said compartment, a pair of spiral springs wound around respective reel and co-extending through said lower and upper clamps and at most up to said upper pulley, a pull rope wound around a lower pulley and extending over said upper and middle pulleys and finally out of said shank, and a slide block engaged on said rope; and an actuator with a pair of presses to actuate and release said upper and lower clamps, respectively, for controlling the operation of opening and closing the umbrella.

2. An automatic umbrella according to claim 1, wherein when said rope is pulled, said spiral springs will be brought and raised at most close to said upper pulley in a course approximately equal to the length of said shank, thereby an active energy is accumulated under the extension of said springs; and wherein when said active energy is released, said springs will return only a distance equal to the displacement of said lower clamp, approximately the length of said handle, much less than said length of said shank.

3. An automatic umbrella according to claim 2, wherein said length of said shank in which said spiral springs are extended to accumulate the active energy is as great as at least twice of said length of said handle in which said lower clamp is displaced when said active energy is released.

* * * * *

UNITED STATES PATENT AND TRADEMARK OFFICE

CERTIFICATE OF CORRECTION

PATENT NO. : 5,174,319
DATED : December 29, 1992
INVENTOR(S) : Luc. L. Chou, Jonathon C. Cheng It is certified that error appears in the above-indentified patent and that said Letters Patent is hereby corrected as shown below:

On the title page, item [73] Assignee: should read as follows:

--[73] Assignee: DAY, Sheng-Tong, Taichung, Taiwan--.

Signed and Sealed this

Twenty-eighth Day of June, 1994

Bruce Lehman

*Attest:*

BRUCE LEHMAN

*Attesting Officer*

*Commissioner of Patents and Trademarks*